US006983824B1

(12) United States Patent
Dandurand

(10) Patent No.: US 6,983,824 B1
(45) Date of Patent: Jan. 10, 2006

(54) PORTABLE STRUCTURAL SYSTEM

(76) Inventor: Billy Joe Dandurand, 1801 Reservation Rd., Hays, KS (US) 67601

( * ) Notice: Subject to any disclaimer, the term of this patent is extended or adjusted under 35 U.S.C. 154(b) by 0 days.

(21) Appl. No.: 10/252,805

(22) Filed: Sep. 23, 2002

Related U.S. Application Data

(60) Provisional application No. 60/370,931, filed on Apr. 9, 2002.

(51) Int. Cl.
*E04G 3/00* (2006.01)
*E04G 3/10* (2006.01)

(52) U.S. Cl. ..... 182/82; 182/150

(58) Field of Classification Search ..... 182/82, 182/150, 45

See application file for complete search history.

(56) References Cited

U.S. PATENT DOCUMENTS 2,718,378 A * 9/1955 Lutton ..... 248/235
3,082,843 A * 3/1963 Henderson ..... 182/82
4,392,550 A 7/1983 Bergeron
4,452,336 A * 6/1984 Sickler ..... 182/82
4,673,060 A 6/1987 Gregory
5,052,581 A * 10/1991 Christ et al. ..... 248/211
5,156,235 A * 10/1992 Preston
5,771,991 A * 6/1998 Fresco ..... 182/82
5,799,750 A 9/1998 Garcia
5,878,838 A 3/1999 Lapp
6,003,630 A * 12/1999 Whallen
6,003,631 A 12/1999 Knauth
6,026,932 A 2/2000 Comp
6,131,698 A 10/2000 Reyland
6,446,752 B2 * 9/2002 Philippe

* cited by examiner

*Primary Examiner*—Hugh B. Thompson, II

(57) ABSTRACT

The present invention is an improved, portable structural system which employs braces that are adapted to engage supporting lengths of construction material such as standard 2×4 studs or standard pipes. The braces have two spaced upper and lower inboard fittings which mount to supporting lengths of construction material. When the upper and lower inboard fittings are clamped to supporting lengths of construction material, horizontal supports of the braces can support a plank or a panel which can be used by a worker as a scaffold, shelf or workbench. The braces may also have outboard fittings for attaching to vertical lengths of construction material for supporting the outboard ends of the braces.

9 Claims, 4 Drawing Sheets

422A
322A
356B
356
460B
460E
460F
9-9

460B
422
502
356B
460D
460A
356
322A
460C 452A
352A
364B
470E
470E 8-8
364A
352
470C
470D
356A
322
460B
460C
460D
470B
470A
364
368
460A
356
320
360

352
355A
353
353A
354B
354C
354A
354

353A
352
353
355A
353B
354
354B
354C
354A
352A

PORTABLE STRUCTURAL SYSTEM

CROSS REFERENCES TO RELATED APPLICATIONS

This application claims the benefit of U.S. Provisional Patent Application No. 60/370,931 filed Apr. 9, 2002.

FIELD OF THE INVENTION

This invention relates to a portable structural system for supporting horizontal work surfaces such as scaffold planks, workbenches and shelves which includes braces that mount to upright lengths of standard construction materials such as steel pipes or 2×4 studs.

BACKGROUND OF THE INVENTION

The installation of scaffolds or workbenches at a construction site may require extensive, specialized structural components that must be taken to a job site, assembled for use and then disassembled and removed after use. Moreover, there is often a need for a standard brace for supporting work benches or shelves that can securely mount to the upright studs of a frame. What is needed a system that includes portable, standardized, reusable braces and fittings that can mount to commonly available construction materials such as upright 2×4 studs to provide the supporting structure for a scaffold, a shelf or a workbench. What is also needed is such a structural system that can be assembled and disassembled very rapidly.

SUMMARY OF THE INVENTION

Accordingly, it is object of the present invention is to provide a portable structural system that employs reusable, portable braces and fittings that can be mounted to commonly available construction materials. It is another object of this invention to provide reusable braces having fittings that mount to upright lengths of construction material such as the studs of wood frame structures. It is yet another object of the present invention to provide compact, reusable braces and fittings for supporting scaffold planks or other work surfaces such as workbenches. It is still yet another object of the present invention to provide a portable structural system that can be assembled and disassembled very rapidly.

These and other objects of the invention are attained in an improved, portable scaffolding system which employs braces that are particularly adapted, at their inboard ends, to mount to standard 2×4 studs. Each brace has spaced upper and lower inboard fittings fixed to their inboard end which are aligned and configured for receiving and securing to vertical lengths of 2×4 studs such as the type of 2×4 studs that are typically used to frame wood structures. A horizontal support projects from the upper inboard fitting and a diagonal support joins the horizontal support and the lower outboard fitting. When the braces are mounted to uprights 2×4 studs, the horizontal supports of the braces provide support for a working surface such as a panel for a workbench, planks for shelves or planks for scaffolding. The panel or planks can also be clamped to the horizontal supports of the braces to further stabilize the structure. To provide additional support, an outboard fitting can be added to the brace opposite the upper inboard fitting. The outboard fitting can be configured to clamp to a stud or a vertical length of standard pipe to provide an outboard support for each brace. Base fittings can also be provided for securing the lower ends of the outboard supports to a floor.

As can be seen from the forgoing description, the portable structural system includes components that can be used with readily available lengths of construction material to erect a complete structure. Because the majority of the structure is comprised of standard, available materials such as standard pipe or 2×4 studs, the braces and other supporting hardware can be easily transported to a work site and can be assembled and disassembled very rapidly.

BRIEF DESCRIPTION OF THE DRAWINGS

The invention and its many attendant objects and advantages will become better understood upon reading the following detailed description of the preferred embodiment in conjunction with the following drawings, wherein.

DETAILED DESCRIPTION OF THE INVENTION

Figure 1:
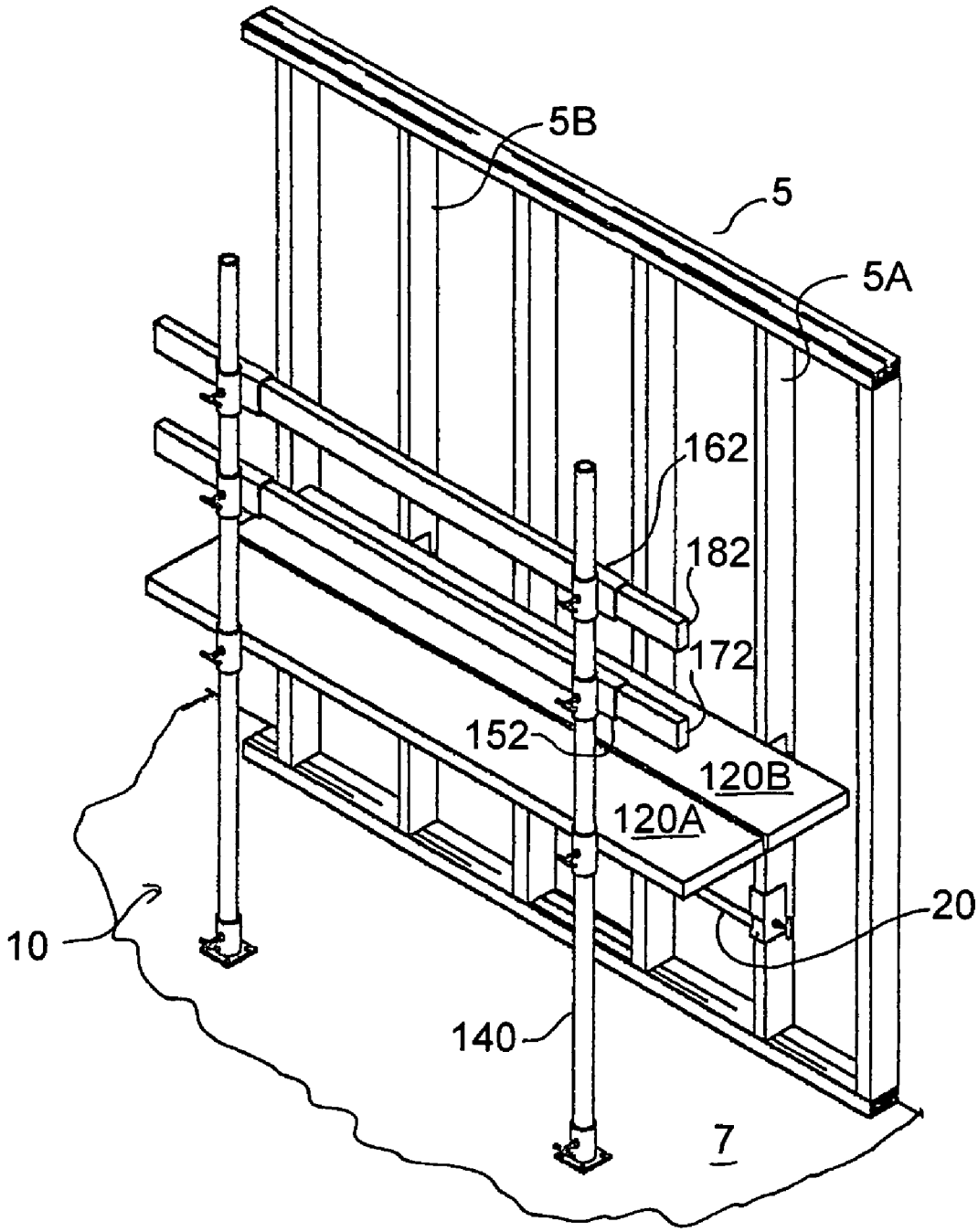
FIG. 1 is a perspective view of the invention scaffolding system shown in relation to a wood frame structure.

Turning now to the drawings, wherein like reference numerals identify identical or corresponding elements, and more particularly to FIG. 1 thereof, a portable structure 10 is shown in relation to frame structure 5 which includes upright 2×4 studs 5A and 5B. Portable structure 10 should be understood to encompass a scaffold structure for supporting workers, a structure for supporting a horizontal panel to provide a workbench or even structure for supporting a storage shelf or series of storage shelves. Portable structure 10 includes left and right brace assemblies 12 which are substantially identical. As shown in FIG. 1, brace assemblies 12 each include a brace 20, and an outboard support member 140. It should be understood that outboard support member 140 can be replaced by an upright wooden stud such as a standard 2×4. In FIG. 1, brace 20 is shown supporting two scaffold planks 120A and 120B. Outboard support member 140 as shown in FIG. 1 is a length of standard pipe. Outboard member 140 stands upon a base fitting 142 and it carries a lower rail fitting 152 and an upper rail fitting 162 which receive and support rails 172 and 182 respectively.

Figure 2:
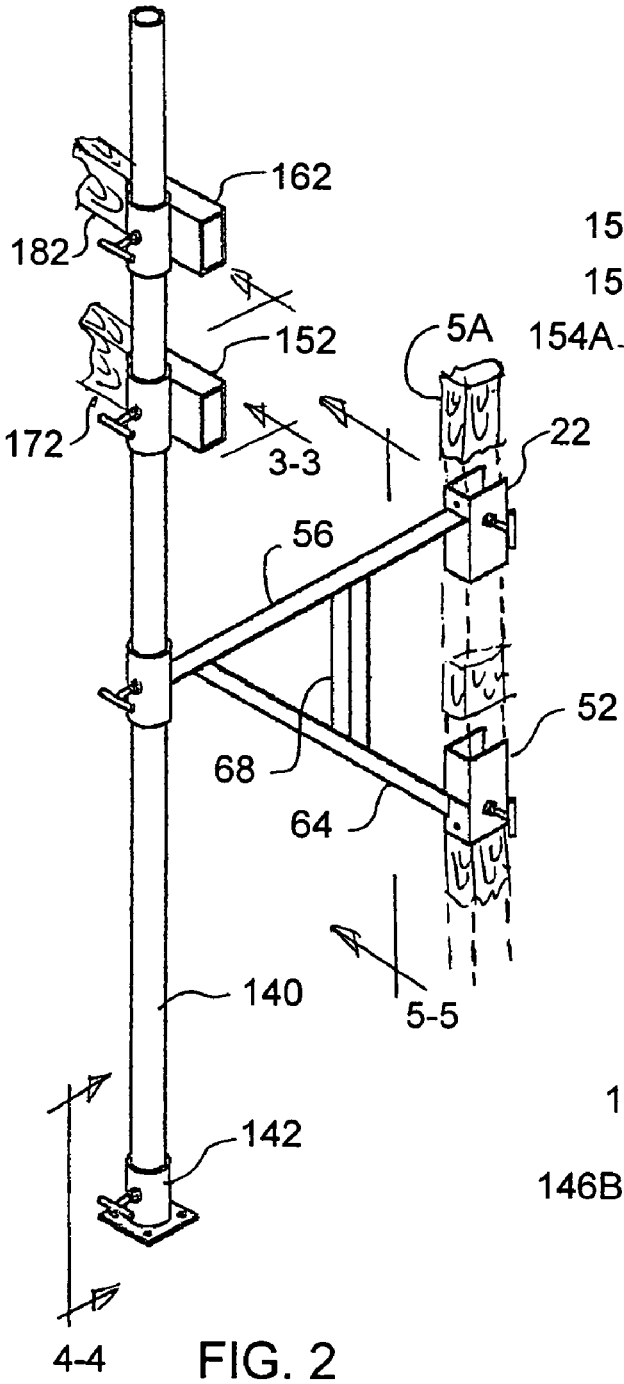
FIG. 2 is a perspective view of a brace assembly of the invention scaffolding system.

Brace assembly 12 is shown in greater detail in FIG. 2. Brace assembly 12 includes a brace 20 which engages stud 5A with an upper inboard fitting 22 and a lower inboard fitting 52. A horizontal member 56 projects generally horizontally from upper inboard fitting 22. An outboard fitting 60 is fixed to the end of horizontal member 56 opposite upper inboard fitting 22. A diagonal member 64 rigidly connects horizontal member 56 and lower inboard fitting 52. A strut 68 reinforces brace 20 by rigidly connecting horizontal member 56 and diagonal member 64.

As can be seen in FIG. 2, outboard fitting 60 of brace 20 clamps to outboard member 140 by means of a T-bolt 60A. T-bolt 60A has a threaded shaft that is received by a threaded insert 60B which is welded to outboard fitting 60. The wall of outboard fitting includes a hole (not shown) so that T-bolt 60A can be engage the surface of outboard member 140 and be turned to apply a clamping force against outboard member 140. It should be understood that outboard member 140 can be another type of material such as a 2×4 stud if outboard fitting 60 of brace 20 is adapted to receive another type of material.

Figure 3:
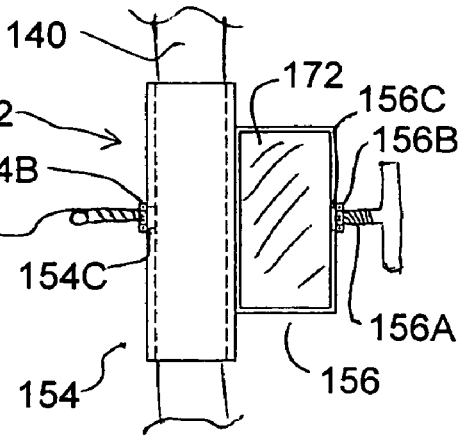
FIG. 3 is a view taken from plane 3—3 of FIG. 2 showing a rail fitting.

FIG. 3, which is taken from plane 3—3 of FIG. 2., illustrates lower rail fitting 152 in greater detail. Rail fitting 152 mounts lower rail 172 to outboard member 140. It is to be understood that upper rail fitting 162 has the same configuration as lower rail fitting 152 and performs the same function for upper rail 182. As can be seen in FIG. 3, lower rail fitting 152 includes a first portion 154 for receiving and clamping to outboard member 140 and a second portion 156 for receiving and clamping to lower rail 172. As with outboard fitting 60, first portion 154 of lower rail fitting 152 includes a T-bolt 154A and a threaded insert 154B as well as a hole 154C for receiving T-bolt 154A. Second portion 156 of lower rail fitting also includes a T-bolt 156A, a threaded insert 156B and a hole 156C for receiving T-bolt 156A. When T-bolt 154A and T-bolt 156A are turned tightly against outboard member 140 and lower rail 172 respectively, lower rail 172 is firmly mounted to outboard member 140.

Figure 4:
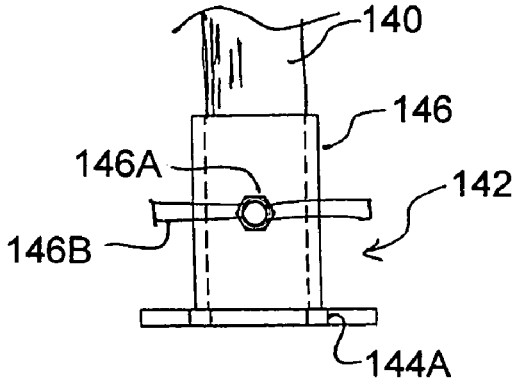
FIG. 4 is a view taken from plane 4—4 of FIG. 2 showing a base fitting.

FIG. 4 is taken from plane 4—4 of FIG. 2. FIG. 4 illustrates base fitting 142 in greater detail. Base fitting 142 provides a base for outboard member 140. As can be seen in FIG. 4, base fitting 142 includes a flat base flange 144 for resting upon a flat surface and cylindrical body 146 for receiving outboard member 140. Flange 144 includes fastener holes 144A for optionally receiving fasteners (not shown) for fastening base fitting 142 to a floor such as floor 7 shown in FIG. 1. Fixed to cylindrical body 146 is a threaded insert 146A which aligns with a hole in the wall of cylindrical body 146 (not shown). The threaded insert receives a T-bolt 146B. When T-bolt 146B is tightened against outboard member 140, outboard member 140 is provided with a securely mounted base.

Figure 5A:
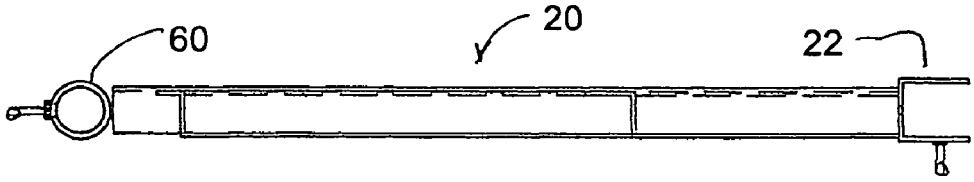
FIG. 5A is a top view of the brace shown in FIG. 5.
Figure 5:
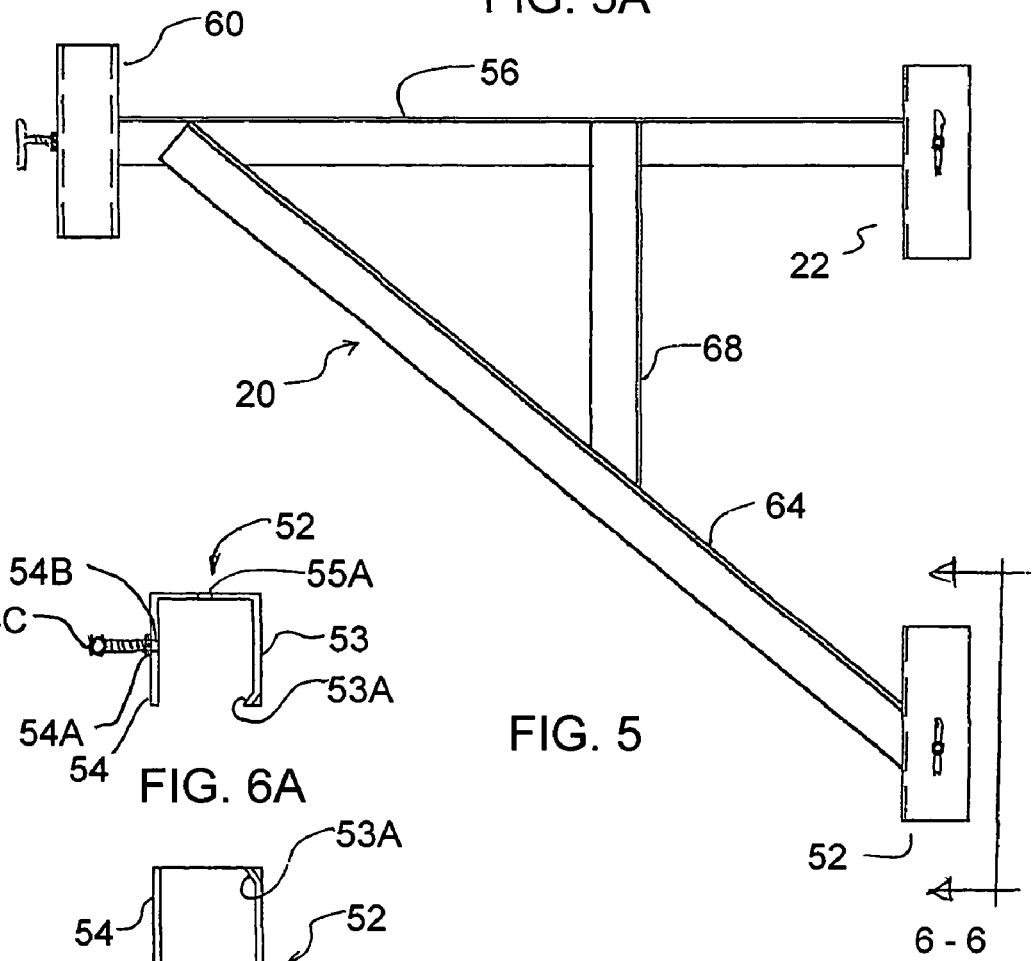
FIG. 5 is a view taken from plane 5—5 of FIG. 2 showing a brace.

FIG. 5 is taken from plane 5—5 of FIG. 2 and FIG. 5A is a top view of brace 20. Brace 20 is an important component of this structural system. A spaced pair of braces such as brace 20 can be used to support a workbench or a shelf. A simple but very sturdy workbench can be constructed using a spaced pair of braces such as brace 20 where the braces are supported by outboard members and where the work surface is strong, rigid panel of material that is firmly clamped to both braces.

Brace 20 is designed to mount to an upright stud and provide a horizontal support for a working surface such as a shelf, workbench surface or scaffold planks. Brace 20 may be mounted to a free standing stud, as long as that free standing stud is otherwise supported. Brace 20 is primarily designed to provide a brace that securely mounts to a frame structure such as might be found in an unfinished interior building space or an unfinished garage. Brace 20 can even be used with a frame structure when dry wall is covering that frame structure if a small portion of that dry wall is removed.

Upper and lower inboard fittings 22 and 52 are designed to clamp to an upright stud. Upper and lower inboard fittings 22 and 52 are shaped and aligned to be compatible with the geometry of a stud. Upper and lower inboard fittings 22 and 52 can also be fastened to a stud with the installation of fasteners such a wood screws for additional support. It is to be understood that upper inboard fitting 22 of brace 20 has the same basic configuration as lower inboard fitting 52 and performs the same basic function of clamping to stud 5A in the same basic way as lower inboard fitting 52.

Figure 6A:
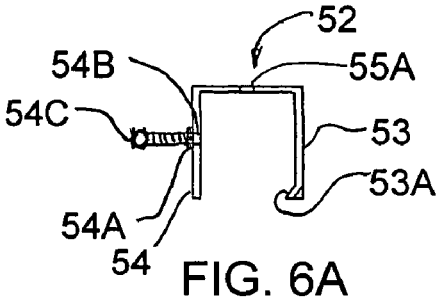
FIG. 6A is a top view of the lower inboard fitting shown in FIG. 6.
Figure 6:
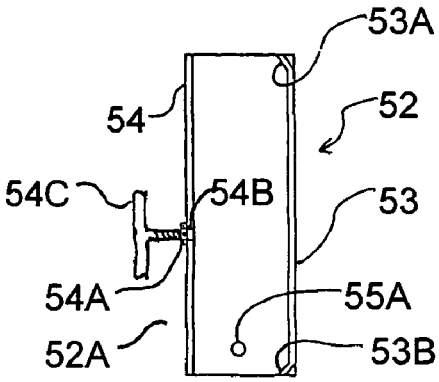
FIG. 6 is a view taken from plane 6—6 of FIG. 5 showing a lower inboard fitting.

Lower inboard fitting 52 is particularly designed to grip a 2×4 stud. FIG. 6, which is taken from plane 6—6 of FIG. 5, provides a detailed view of lower inboard fitting 52. FIG. 6A is a top view of lower inboard fitting 52. Lower inboard fitting 52 includes a channel shaped body 52A which is welded to the lower end of diagonal member 64. Channel shaped body 52A has first and second parallel flanges 53 and 54 which are spaced to accommodate the width of a structural stud. Formed into the corners of first flange 53 are two inwardly projecting cleats 53A and 53B. A threaded insert 54A is fixed to second flange 54. Threaded insert 54A aligns with a hole 54B in second flange 54. Threaded insert 54A receives a correspondingly threaded T-Bolt 54C. When T-Bolt 54C is tightened against a stud, cleats 53A and 53B are forced against the surface of the stud, penetrate the surface of the stud so that lower inboard fitting 52 grips the stud. Lower inboard fitting 52 also has a fastener hole 55A so that wood screw can be installed in order to more securely attach lower inboard fitting 52 to a stud. Brace 20 and the other fittings described above are preferably made from at least medium grade steel having a material thickness sufficient to carry significant loads and function without deforming plastically. As noted above, brace 20 and the fittings described above can be repeated in various combinations to construct shelves, workbenches and scaffolding. Because available materials are used to construct these structures, limited amounts of the specialized hardware described above are needed to construct an extensive structure. Because simple T-Bolt clamps are used repetitively in brace 20 and the other fittings described above, a entire structure can be assembled very rapidly. Structures constructed using the portable structural system can have a wide range of load carrying capacities depending on the number and spacing of braces and the degree to which braces are fastened to frame studs and the degree to which planking is clamped to the braces. These things can be accomplished with the repetitious use of the fittings and braces described above.

Figures 7, 7A, 7B, 8, 8A, 9:
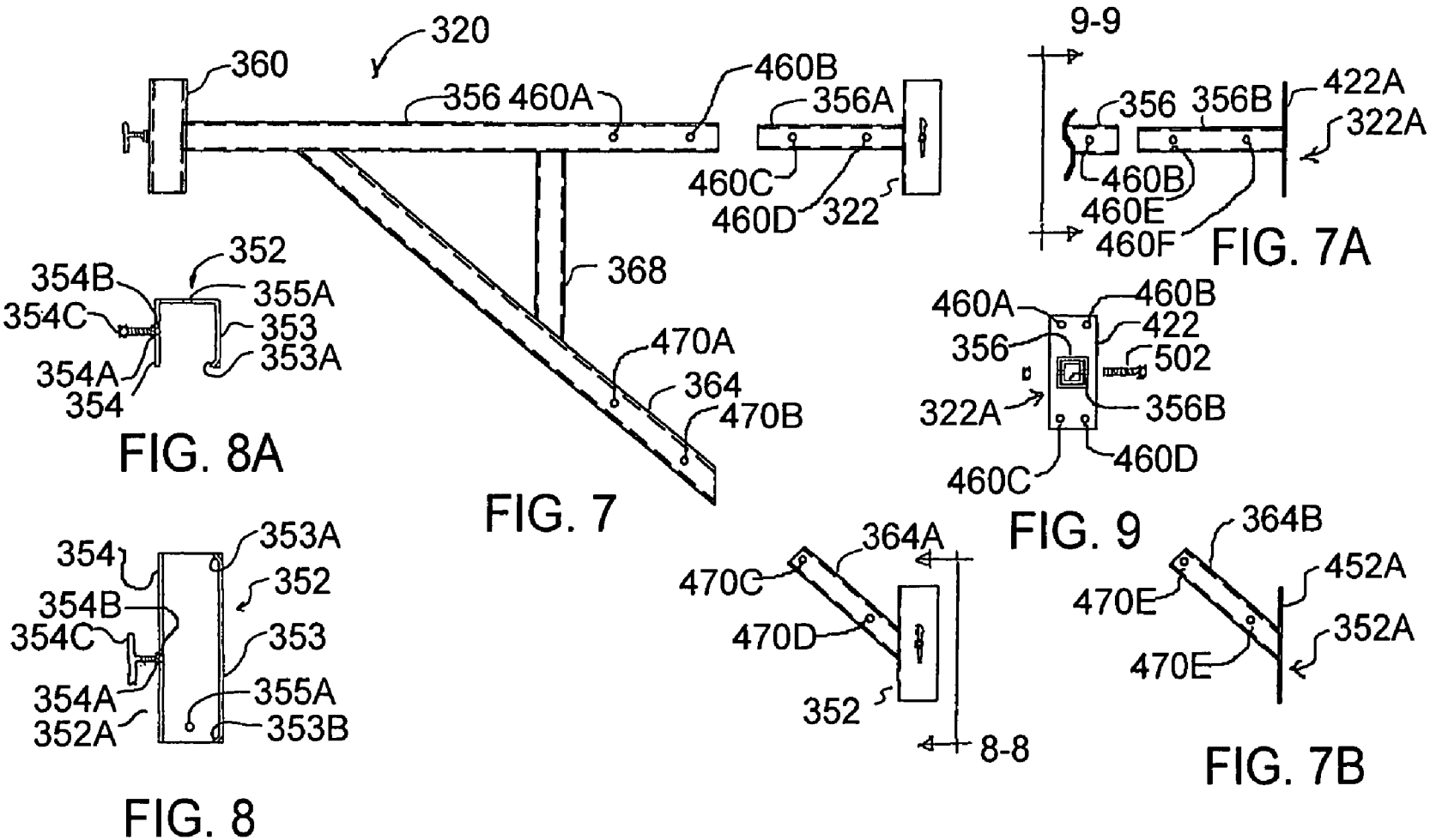
FIG. 7 is a side view of an alternate brace.
FIG. 7A is a side view of an alternate upper fitting for the brace of FIG. 7.
FIG. 7B is a side view of an alternate lower fitting for the brace of FIG. 7.
FIG. 8 is a view taken from plane 8—8 of FIG. 7.
FIG. 8A is a top view of the lower inboard fitting shown in FIG. 8.
FIG. 9 is a view taken from plane 9—9 of FIG. 7A.

FIG. 7 shows an alternate brace 320 of the invention structural system. Alternate brace 320 includes interchangeable inboard fittings which can be mounted to standard interfaces presented by the horizontal and diagonal members of brace 320. The interchangeable inboard fittings of brace 320 are designed to accommodate either vertical studs or a flat wall surface backed by vertical studs. FIG. 7 shows alternate brace as disassembled. However, alternate brace 320 should be completely assembled using one of the two sets of inboard fittings shown, as appropriate, before alternate brace 320 is mounted to a frame structure or a wall.

Brace 320 is fashioned from steel tube having a square cross section. Brace 320 includes a horizontal member 356, a strut 368 and a diagonal member 364. Upper and lower inboard fittings 322 and 352 shown in FIG. 7 or upper and lower inboard fittings 322A and 352A shown in FIGS. 7A and 7B can be interchangeably fixed to brace 320. Upper inboard fitting 322 includes a horizontal connecting member 356A which mates to horizontal member 356. Lower inboard fitting 322 includes a diagonal connecting member 364A which mates to diagonal member 364. Corresponding fastener holes 402, 404, 402A and 404A in horizontal connecting member 356A and horizontal member 356 receive fasteners 502 as shown in FIG. 9. A similar arrangement including fastener holes 470A, 470B, 470C and 470D in diagonal connecting member 364A and diagonal member 364 also receive fasteners substantially as shown in FIG. 9.

As can be seen in FIGS. 8 and 8A, upper and lower inboard fittings 322 and 352 are substantially identical to upper and lower inboard fittings 22 and 52 of brace 20 shown in FIGS. 6 and 6A. Lower inboard fitting 352 shown in FIGS. 8 and 8A includes a channel shaped body 352A which is welded to the inboard lower end of diagonal connecting member 364. Channel shaped body 352A has first and second parallel flanges 353 and 354 which are spaced to accommodate the width of a structural stud. Formed into the corners of first flange 353 are two inwardly projecting cleats 353A and 353B. A threaded insert 354A is fixed to second flange 354. Threaded insert 354A aligns with a hole 354B in second flange 354. Threaded insert 354A receives a correspondingly threaded T-Bolt 354C. When T-Bolt 354C is tightened against a stud, cleats 353A and 353B are forced against the surface of the stud, penetrate the surface of the stud so that lower inboard fitting 352 grips the stud. Lower inboard fitting 352 also has a fastener hole 355A so that wood screw can be installed in order to more securely attach lower inboard fitting 352 to a stud.

As can be seen in FIGS. 7A, 7B and 9, alternate upper and lower inboard fittings 322A and 352A do not have channel shaped bodies but have mounting plates 422A and 452A which are welded to the inboard ends of alternate horizontal connecting member 356B and alternate diagonal connecting member 364B respectively. Alternate horizontal connecting member 356B of alternate upper inboard fitting 322A includes a pair of fastener holes 460E and 460F which match fastener holes 460A and 460B of horizontal member 356. In the same way, alternate diagonal connecting member 364B includes a pair of fastener holes 470E and 470F which match fastener holes 470A and 470B of diagonal member 364. Fasteners such as fastener 502 shown in FIG. 9 are used to fasten alternate upper and lower inboard fittings 322A and 352A to brace 320. Alternate upper and lower inboard fittings 322A and 352A each have a mounting plate such as mounting plate 422A shown in FIG. 9. Mounting plate 422A has a pattern of fastener holes 460A, 460B, 460C and 460D which receive fasteners such as wood screws which are used to fasten brace 320 to the vertical studs behind the wall board or the sheet rock of a wall.

As can be understood from the above description, brace 320 may be mounted either to a frame including vertical studs using fittings 322 and 352 or to a flat wall including a frame covered by wall board or dry wall using alternate fittings 322A and 352A. With this arrangement, a workman can quickly select and assemble interchangeable components such that braces can be mounted either to flat surfaces or a framework that include vertical studs.

Brace 20 and brace 320 and the other fittings described above are preferably made from at least medium grade steel having a material thickness sufficient to carry significant loads and function without deforming plastically. As noted above, brace 20, brace 320 and the fittings described above can be repeated in various combinations to construct shelves, workbenches and scaffolding. Because available materials are used to construct these structures, limited amounts of the specialized hardware described above are needed to construct an extensive structure. Because simple T-Bolt clamps and other standard fasteners are used repetitively in brace 20 and brace 320 and the other fittings described above, a entire structure can be assembled very rapidly. Structures constructed using the portable structural system can have a wide range of load carrying capacities depending on the number and spacing of braces and the way in which braces are fastened to frame studs and the way in which working surfaces are clamped to the braces. Accordingly, a multitude of configurations can be constructed by using the fittings and braces described above.

Accordingly, the portable structural system described above meets an objective of the invention by providing a portable structural system that employs reusable, portable braces and fittings that can be mounted to commonly available construction materials. The portable structural system described above meets an another object of this invention by providing compact braces that can be quickly mounted to wooden studs in frame structures. The portable structural system described above meets yet another object of the present invention by providing braces and fittings that can be used with a very high degree of versatility to construct scaffolding systems, shelves, shelving systems and workbenches.

Numerous modifications and variations of this preferred embodiment may occur to those skilled in the art in light of this disclosure. Accordingly, it is expressly to be understood that these modifications and variations, and equivalents thereof, shall be considered to be within the spirit and scope of the invention as defined in following claims, wherein

I claim:

1. A portable structural system for supporting horizontal surfaces, comprising:

at least two braces, each of the at least two braces having an inboard end and an outboard end, a horizontal support extending from the inboard end to the outboard end for supporting a working surface, upper and lower inboard fittings fixed to the inboard end of each of the at least two braces, each upper and lower inboard fitting including a channel shaped body including first and second parallel flanges spaced to receive a standard, upright wood stud, and at least each upper inboard fitting further including:

(a) cleats projecting from the first flange of the channel shaped body for penetrating the wood stud, (b) a threaded bolt and threaded insert arrangement mounted to the second flange of the channel shaped body whereby when the threaded bolt is tightened into the stud, the first flange and the cleats are clamped against the surface of the wood stud as the cleats penetrates the surface of the wood stud, whereby at least each upper inboard fitting may grip the standard upright wood stud.

2. The portable structural system of claim 1 wherein, the upper and lower inboard fittings are releasably secured to the inboard end of each of the at least two braces such that the upper and lower inboard fittings can be interchangeably removed and replaced by a second set of upper and lower inboard fittings having flat plates with fastener holes for mounting to a flat wall surface, whereby the portable structural system may be quickly and easily configured to be mounted to an open frame structure including vertical studs or configured to be mounted to a flat wall.

3. The portable structural system of claim 1 wherein, at least one of the braces also has an outboard fitting for releasably mounting to an upright length of material for supporting the outboard end of the at least one brace.

4. The portable structural system of claim 1 wherein, at least one of the braces also has an outboard fitting for releasably mounting to an upright length of material for supporting the outboard end of the at least one brace, and, wherein, at least one of the upper inboard fitting and the lower inboard fitting includes an opening for receiving a fastener for installing a fastener for further securing the fitting to the standard wood stud.

5. A portable structural system for supporting horizontal surfaces, comprising:

(a) at least two braces, each of the at least two braces having an inboard end and an outboard end, a horizontal support extending from the inboard end to the outboard end for supporting a working surface, upper and lower inboard fittings fixed to the inboard end of each of the at least two braces, each upper and lower inboard fitting including a channel shaped body including first and second parallel flanges spaced to receive a standard, upright wood stud, and at least each upper inboard fitting further including:

(i) cleats projecting from the first parallel flange of the channel shaped body for penetrating the wood stud, (ii) a bolt and threaded insert arrangement mounted to the second parallel flange whereby when the bolt is tightened into the stud, the first flange and the cleats projecting from the first flange are clamped against the surface of the wood stud and penetrate the surface of the stud, so that each fitting may grip the standard upright wood stud, (b) each of the at least two braces also having an outboard fitting for releasably mounting to an upright length of material for supporting the outboard end of each of the at least two braces, and, (c) rail fittings that can be releasably secured to the upright length of material for supporting rails mounted to more than one upright length of material supporting the outboard ends of more than one brace.

6. The portable structural system of claim 5 wherein, at least one of the upper inboard fitting and the lower inboard fitting includes an opening for receiving a fastener for installing a fastener for further securing the fitting to the standard wood stud.

7. The portable structural system of claim 5 further comprising, a base fitting that is releasably securable to the lower end of the length of material for supporting the outboard end of a brace.

8. The portable structural system of claim 5, further comprising, (a) an opening in at least one of the upper inboard fitting and the lower inboard fitting for receiving a fastener for installing a fastener for further securing the fitting to the standard wood stud, and, (b) a base fitting that is releasably securable to the lower end of the length of material for supporting the outboard end of a brace.

9. The portable structural system of claim 5 wherein, the upper and lower inboard fittings are releasably secured to the inboard end of each of the at least two braces such that the upper and lower inboard fittings can be interchangeably removed and replaced by a second set of upper and lower inboard fittings having flat plates with fastener holes for mounting to a flat wall surface, whereby the portable structural system may be quickly and easily configured to be mounted to an open frame structure including vertical studs or configured to be mounted to a flat wall.

* * * * *